US011649610B2

(12) United States Patent
Kondo et al.

(10) Patent No.: US 11,649,610 B2
(45) Date of Patent: May 16, 2023

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Naoki Hata, Kobe (JP); Nobuyuki Kinoshita, Kobe (JP); Kazuya Iwabe, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/637,378

(22) PCT Filed: Jul. 31, 2020

(86) PCT No.: PCT/JP2020/029480
§ 371 (c)(1),
(2) Date: Feb. 22, 2022

(87) PCT Pub. No.: WO2021/039284
PCT Pub. Date: Mar. 4, 2021

(65) Prior Publication Data

US 2022/0316186 A1 Oct. 6, 2022

(30) Foreign Application Priority Data

Aug. 23, 2019 (JP) ..... JP2019-152659

(51) Int. Cl.
*E02F 9/22* (2006.01)
*F15B 13/044* (2006.01)

(52) U.S. Cl.
CPC ..... *E02F 9/2228* (2013.01); *E02F 9/2267* (2013.01); *E02F 9/2285* (2013.01);
(Continued)

(58) Field of Classification Search
CPC ..... F15B 13/044; F15B 2211/63; F15B 2211/30525; F15B 2211/329; F15B 2211/355; F15B 2211/41554; F15B 2211/41563; F15B 2211/428; F15B 2211/50536; F15B 2211/528;
(Continued)

(56) References Cited

U.S. PATENT DOCUMENTS 7,513,109 B2 * 4/2009 Toji ..... F15B 11/166 91/461
9,765,503 B2 * 9/2017 Lee ..... E02F 9/2228
(Continued)

FOREIGN PATENT DOCUMENTS

JP 2017-110672 A 6/2017

*Primary Examiner* — Thomas E Lazo
(74) *Attorney, Agent, or Firm* — Oliff PLC

(57) ABSTRACT

A hydraulic system of a construction machine includes: control valves interposed between a main pump and hydraulic actuators; and first solenoid proportional valves connected to pilot ports of the control valves. The hydraulic system further includes: an unloading valve including a pilot port; and a second solenoid proportional valve connected to the pilot port of the unloading valve by a secondary pressure line and connected to an auxiliary pump by a primary pressure line. A switching valve including a pilot port connected to the secondary pressure line by a pilot line is interposed between the auxiliary pump and the first solenoid proportional valves.

10 Claims, 5 Drawing Sheets

(52) U.S. Cl.
CPC ..... *E02F 9/2292* (2013.01); *F15B 13/044* (2013.01); *E02F 9/2296* (2013.01); *F15B 2211/63* (2013.01)

(58) Field of Classification Search
CPC ..... E02F 9/2228; E02F 9/2267; E02F 9/2285; E02F 9/2292; E02F 9/2296
See application file for complete search history.

(56) References Cited

U.S. PATENT DOCUMENTS

| | | | | |
|---|---|---|---|---|
| 9,784,266 | B2 * | 10/2017 | Bang | E02F 9/2228 |
| 10,227,090 | B2 * | 3/2019 | Kondo | E02F 9/2285 |
| 2010/0100274 | A1 * | 4/2010 | Satake | E02F 9/2285 701/31.4 |
| 2015/0292184 | A1 * | 10/2015 | Kondo | F15B 13/0426 91/518 |
| 2017/0166253 | A1 * | 6/2017 | Kondo | E02F 9/2267 |
| 2022/0267997 | A1 * | 8/2022 | Kondo | E02F 9/2235 |
| 2022/0282453 | A1 * | 9/2022 | Kondo | E02F 9/2228 |
| 2022/0290408 | A1 * | 9/2022 | Kondo | E02F 9/2292 |
| 2022/0316186 | A1 * | 10/2022 | Kondo | F15B 20/00 |

* cited by examiner

HYDRAULIC SYSTEM OF CONSTRUCTION MACHINE

CROSS-REFERENCE TO RELATED APPLICATIONS

This is a U.S. National Phase of International Application No. PCT/JP2020/029480 filed Jul. 31, 2020, which claims the benefit of Japanese Patent Application No. 2019-152659 filed Aug. 23, 2019. The disclosure of the prior applications is hereby incorporated by reference herein in its entirety.

TECHNICAL FIELD

The present invention relates to a hydraulic system of a construction machine.

BACKGROUND ART

In a hydraulic system installed in construction machines such as hydraulic excavators and hydraulic cranes, control valves are interposed between a main pump and hydraulic actuators. Each of the control valves controls supply and discharge of hydraulic oil to and from a corresponding one of the hydraulic actuators.

Generally speaking, each control valve includes: a spool disposed in a housing; and a pair of pilot ports for moving the spool. In a case where an operation device that outputs an electrical signal is used as an operation device to move the control valve, solenoid proportional valves are connected to the respective pilot ports of the control valve, and the control valve is driven by the solenoid proportional valves.

For example, Patent Literature 1 discloses a configuration for bringing the control valve back to its neutral position when a failure has occurred in the solenoid proportional valves for driving the control valve. In this configuration, a solenoid switching valve is interposed between an auxiliary pump and the solenoid proportional valves for driving the control valve. When a failure has occurred in the solenoid proportional valves for driving the control valve, the solenoid switching valve is switched from an open position to a closed position to stop the supply of the hydraulic oil from the auxiliary pump to the solenoid proportional valves. That is, when a failure has occurred in the solenoid proportional valves for driving the control valve, even if an operator operates the operation device, the control valve is kept in the neutral position and the operation performed on the operation device is invalidated.

CITATION LIST

Patent Literature

PTL 1: Japanese Laid-Open Patent Application Publication No. 2017-110672

SUMMARY OF INVENTION

Technical Problem

However, the configuration disclosed in Patent Literature 1 requires a solenoid valve that is dedicated for invalidating an operation performed on the operation device.

In view of the above, an object of the present invention is to provide a hydraulic system of a construction machine, the hydraulic system making it possible to invalidate operations performed on operation devices without using a solenoid valve that is dedicated for invalidating operations performed on the operation devices.

Solution to Problem

In order to solve the above-described problems, the inventors of the present invention have paid attention to the fact that, among various hydraulic systems of construction machines, some of them are configured such that while no operation device is being operated, an unloading valve for keeping the delivery pressure of the main pump low is driven by a solenoid proportional valve. Then, the inventors have come up with an idea that it may be possible to use the solenoid proportional valve for invalidating an operation performed on an operation device. The present invention has been made from such a technological point of view.

Specifically, a hydraulic system of a construction machine according to the present invention includes: control valves interposed between a main pump and hydraulic actuators, each control valve including pilot ports; first solenoid proportional valves connected to the pilot ports of the control valves; operation devices to move the control valves, each operation device outputting an electrical signal corresponding to an operating amount of the operation device; a controller that controls the first solenoid proportional valves based on the electrical signals outputted from the operation devices; an unloading valve provided on a line extending to a tank, the line being branched off from a supply line that connects between the main pump and the control valves, the unloading valve including a pilot port and being a valve whose opening area is at a maximum when none of the operation devices are operated; a second solenoid proportional valve connected to the pilot port of the unloading valve by a secondary pressure line and connected to an auxiliary pump by a primary pressure line; and a switching valve interposed between the auxiliary pump and the first solenoid proportional valves, the switching valve including a pilot port connected to the secondary pressure line by a pilot line, the switching valve switching between a closed position and an open position in accordance with a pilot pressure led to the pilot port.

According to the above configuration, whether to switch the switching valve, which is interposed between the auxiliary pump and the first solenoid proportional valves, to the closed position or to the open position, i.e., whether to invalidate or validate operations performed on the operation devices, can be switched based on a secondary pressure of the second solenoid proportional valve. Also, the opening area of the unloading valve can be changed based on the secondary pressure of the second solenoid proportional valve. This allows the second solenoid proportional valve, which is a single valve, to have two functions. Therefore, a solenoid valve dedicated for invalidating operations performed on the operation devices is unnecessary.

For example, the opening area of the unloading valve may decrease in accordance with increase in a pilot pressure led to the pilot port of the unloading valve, and the switching valve may switch from the closed position to the open position when the pilot pressure led to the pilot port of the switching valve becomes higher than or equal to a setting value.

The above hydraulic system may further include: a selector that receives a selection of operation lock, which is a selection to invalidate operations performed on the operation devices, or receives a selection of operation lock release, which is a selection to validate operations performed on the operation devices. While the selector is receiving the selection of operation lock, the controller may control the second solenoid proportional valve, such that a secondary pressure of the second solenoid proportional valve is lower than the setting value. While the selector is receiving the selection of operation lock release, the controller may control the second solenoid proportional valve, such that the secondary pressure of the second solenoid proportional valve is higher than the setting value. According to this configuration, when an operator makes the selection of operation lock with the selector, operations performed on the operation devices are invalidated, whereas when the operator makes the selection of operation lock release with the selector, operations performed on the operation devices are validated.

The setting value may be a first setting value. The opening area of the unloading valve may be kept at the maximum until the pilot pressure led to the pilot port of the unloading valve becomes a second setting value. The first setting value may be lower than or equal to the second setting value. According to this configuration, the switching valve can be switched from the closed position to the open position while the opening area of the unloading valve is kept at the maximum.

The main pump may include a plurality of main pumps. The unloading valve may include a plurality of unloading valves corresponding to the respective main pumps. The second solenoid proportional valve may include a plurality of second solenoid proportional valves corresponding to the respective unloading valves. The pilot line may include: a bridging line that connects secondary pressure lines to each other, the secondary pressure lines extending from the respective second solenoid proportional valves; a high pressure selective valve provided on the bridging line; and an output line that connects between an output port of the high pressure selective valve and the pilot port of the switching valve. According to this configuration, even if one of the second solenoid proportional valves does not work due to a failure or the like, the switching valve can still be switched between the closed position and the open position. Consequently, the occurrence of a situation where the construction machine stops working due to a failure is reduced, and the reliability of the construction machine is improved.

Advantageous Effects of Invention

The present invention makes it possible to invalidate operations performed on operation devices without using a solenoid valve that is dedicated for invalidating operations performed on the operation devices.

DESCRIPTION OF EMBODIMENTS

Embodiment 1

Figure 1:
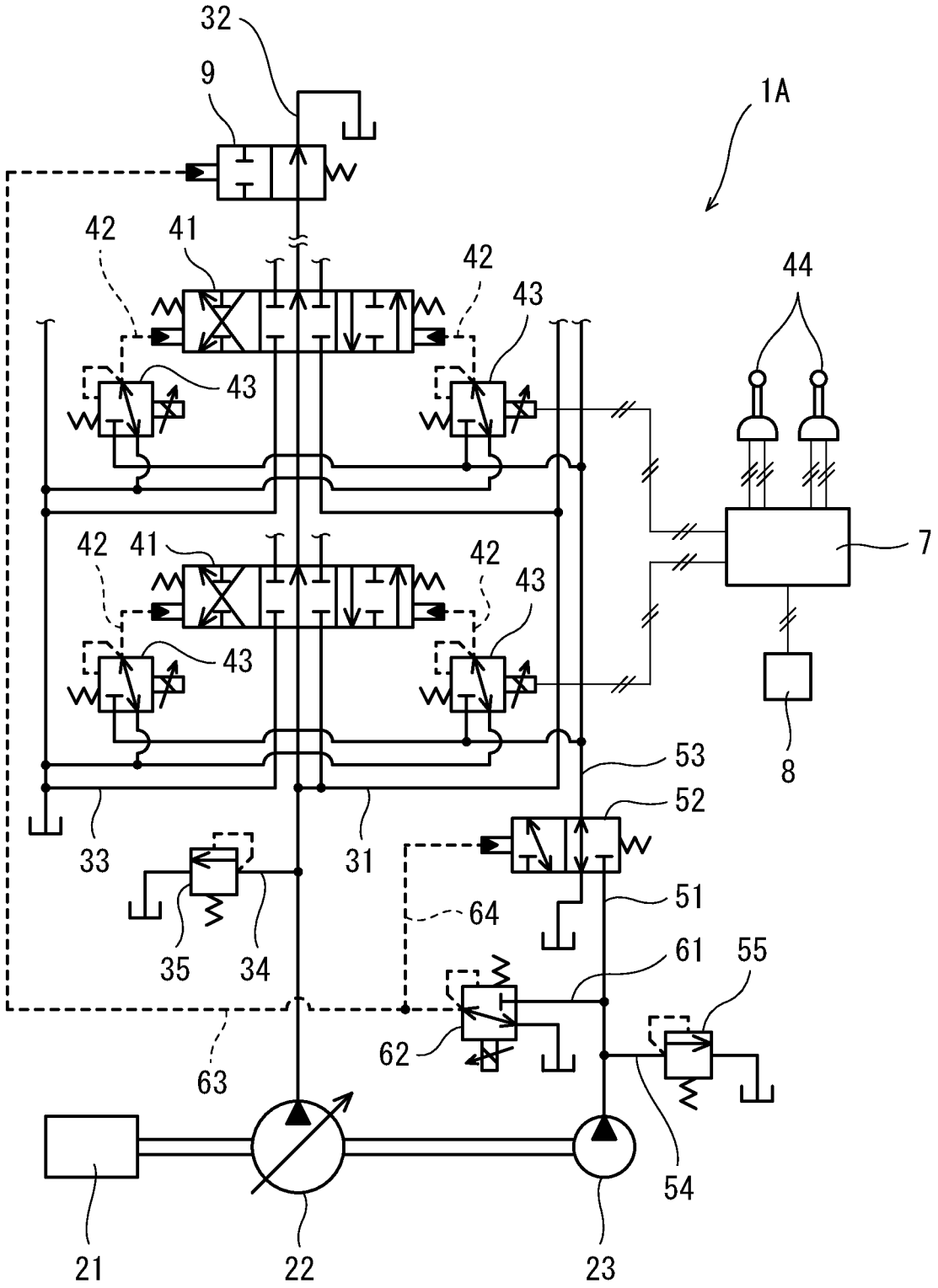
FIG. 1 shows a schematic configuration of a hydraulic system of a construction machine according to Embodiment 1 of the present invention.
Figure 2:
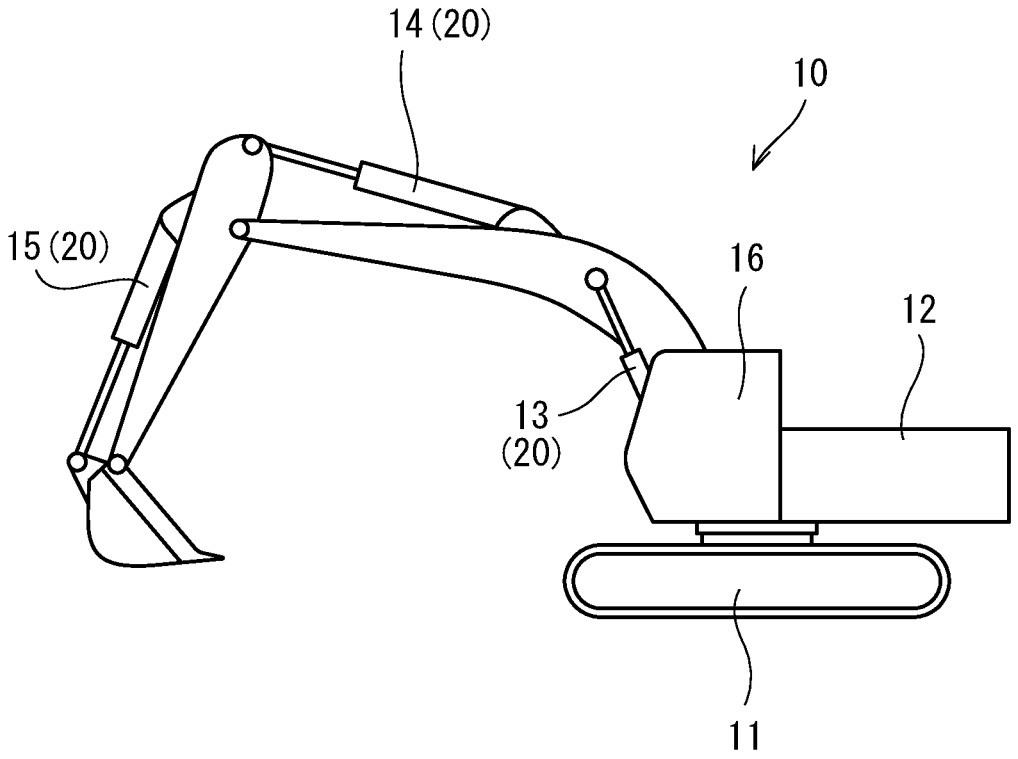
FIG. 2 is a side view of a hydraulic excavator that is one example of the construction machine.

FIG. 1 shows a hydraulic system 1A of a construction machine according to Embodiment 1 of the present invention. FIG. 2 shows a construction machine 10, in which the hydraulic system 1A is installed. Although the construction machine 10 shown in FIG. 2 is a hydraulic excavator, the present invention is applicable to other construction machines, such as a hydraulic crane.

The construction machine 10 shown in FIG. 2 is a self-propelled construction machine, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16 including an operator's seat. The construction machine 10 need not be of a self-propelled type.

The hydraulic system 1A includes, as hydraulic actuators 20, a boom cylinder 13, an arm cylinder 14, and a bucket cylinder 15, which are shown in FIG. 2, an unshown pair of left and right travel motors, and an unshown slewing motor. The boom cylinder 13 luffs the boom. The arm cylinder 14 swings the arm. The bucket cylinder 15 swings the bucket.

As shown in FIG. 1, the hydraulic system 1A further includes a main pump 22, which supplies hydraulic oil to the aforementioned hydraulic actuators 20. In FIG. 1, the hydraulic actuators 20 are not shown for the purpose of simplifying the drawing.

The main pump 22 is driven by an engine 21. Alternatively, the main pump 22 may be driven by an electric motor. The engine 21 also drives an auxiliary pump 23. The number of main pumps 22 may be more than one.

The main pump 22 is a variable displacement pump (a swash plate pump or a bent axis pump) whose tilting angle is changeable. The delivery flow rate of the main pump 22 may be controlled by electrical positive control, or may be controlled by hydraulic negative control. Alternatively, the delivery flow rate of the main pump 22 may be controlled by load-sensing control.

Control valves 41 are interposed between the main pump 22 and the hydraulic actuators 20. In the present embodiment, all the control valves 41 are three-position valves. Alternatively, one or more of the control valves 41 may be two-position valves.

All the control valves 4 are connected to the main pump 22 by a supply line 31, and connected to a tank by a tank line 33. Each of the control valves 41 is connected to a corresponding one of the hydraulic actuators 20 by a pair of supply/discharge lines. In a case where the number of main pumps 22 is more than one, the same number of groups of the control valves 41 as the number of main pumps 22 are formed. In each group, the control valves 41 are connected to the corresponding main pump 22 by the supply line 31.

For example, the control valves 41 include: a boom control valve that controls supply and discharge of the hydraulic oil to and from the boom cylinder 13; an arm control valve that controls supply and discharge of the hydraulic oil to and from the arm cylinder 14; and a bucket control valve that controls supply and discharge of the hydraulic oil to and from the bucket cylinder 15.

The supply line 31 includes a main passage and branch passages. The main passage extends from the main pump 22. The branch passages are branched off from the main passage, and connect to the control valves 41. In the present embodiment, a center bypass line 32 is branched off from the main passage of the supply line 31, and the center bypass line 32 extends to the tank. The control valves 41 are disposed on the center bypass line 32.

A relief line 34 is branched off from the main passage of the supply line 31, and the relief line 34 is provided with a relief valve 35 for the main pump 22. The relief line 34 may be branched off from the center bypass line 32 at a position upstream of all the control valves 41.

The center bypass line 32 is provided with an unloading valve 9 at a position downstream of all the control valves 41. Alternatively, the unloading valve 9 may be provided at a position upstream of all the control valves 41, or may be provided between particular control valves 41. The unloading valve 9 includes a pilot port, and the opening area of the unloading valve 9 is changeable by a pilot pressure led to the pilot port. The opening area of the unloading valve 9 is at a maximum when none of operation devices 44 are operated. The operation devices 44 will be described below.

Figure 4:
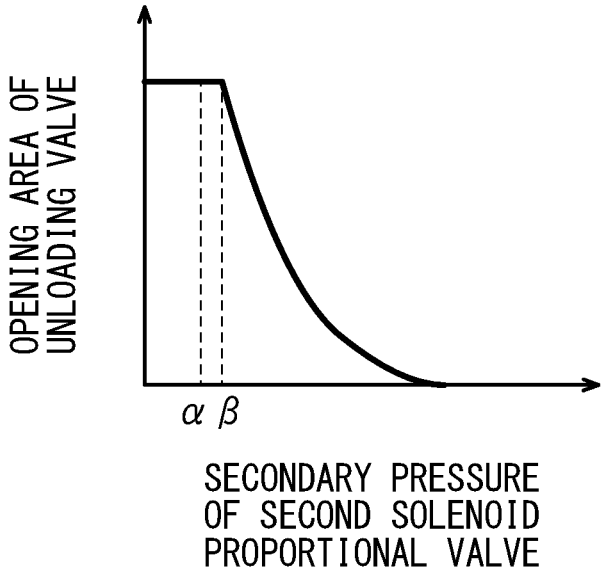
FIG. 4 is a graph showing a relationship between the secondary pressure of the second solenoid proportional valve and an opening area of an unloading valve in Embodiment 1.

In the present embodiment, the unloading valve 9 is a normally open valve. That is, as shown in FIG. 4, the opening area of the unloading valve 9 is at the maximum when the unloading valve 9 is in a neutral position, and the opening area is kept at the maximum until the pilot pressure becomes a setting value β (corresponding to a second setting value of the present invention). When the pilot pressure is higher than the setting value β, the opening area of the unloading valve 9 decreases in accordance with increase in the pilot pressure.

Returning to FIG. 1, each control valve 41 includes: a spool disposed in a housing; and a pair of pilot ports for moving the spool. For example, the housings of all the control valves 41 may be integrated together to form a multi-control valve unit. The pilot ports of each control valve 41 are connected to respective first solenoid proportional valves 43 by respective pilot lines 42.

Each first solenoid proportional valve 43 is a direct proportional valve outputting a secondary pressure that indicates a positive correlation with a command current. Alternatively, each first solenoid proportional valve 43 may be an inverse proportional valve outputting a secondary pressure that indicates a negative correlation with the command current.

All the first solenoid proportional valves 43 are connected to a switching valve 52 by a distribution line 53. The distribution line 53 includes a main passage and branch passages. The main passage extends from the switching valve 52. The branch passages are branched off from the main passage, and connect to the first solenoid proportional valves 43.

The switching valve 52 is connected to the auxiliary pump 23 by a pump line 51. A relief line 54 is branched off from the pump line 51, and the relief line 54 is provided with a relief valve 55 for the auxiliary pump 23. The relief pressure of the relief valve 55 is set sufficiently high (e.g., 4 MPa) so that the spool of each control valve 41 can move to the stroke end. The relief pressure of the relief valve 55 is higher, to some extent, than a pressure that brings the opening area of the unloading valve 9 to its minimum (zero).

The switching valve 52 interposed between the auxiliary pump 23 and all the first solenoid proportional valves 43 includes a pilot port, and switches between a closed position and an open position in accordance with a pilot pressure led to the pilot port. In the present embodiment, the closed position is the neutral position of the switching valve 52. That is, when the pilot pressure becomes higher than or equal to a setting value α (corresponding to a first setting value of the present invention), the switching valve 52 switches from the closed position to the open position.

When the switching valve 52 is in the closed position, the switching valve 52 blocks the pump line 51, and brings the distribution line 53 into communication with the tank. When the switching valve 52 is in the open position, the switching valve 52 brings the pump line 51 into communication with the distribution line 53. In other words, in a state where the switching valve 52 is kept in the closed position, the supply of the hydraulic oil from the auxiliary pump 23 to the first solenoid proportional valves 43 is stopped, and the primary pressure of each first solenoid proportional valve 43 is zero. Accordingly, even when electric currents are fed to the first solenoid proportional valves 43, the control valves 41 do not move.

As shown in FIG. 4, desirably, the setting value α of the switching valve 52 is set to be lower than or equal to the setting value β of the unloading valve 9, because, with such setting, the switching valve 52 can be switched from the closed position to the open position while the opening area of the unloading valve 9 is kept at the maximum. For example, the setting value α is 0.1 to 0.4 MPa, and the setting value β is 0.5 to 0.8 MPa. Alternatively, the setting value α of the switching valve 52 may be greater than the setting value β of the unloading valve 9.

Returning to FIG. 1, the auxiliary pump 23 is connected also to a second solenoid proportional valve 62 by a primary pressure line 61, and the second solenoid proportional valve 62 is connected to the pilot port of the unloading valve 9 by a secondary pressure line 63. The upstream portion of the primary pressure line 61 and the upstream portion of the pump line 51 merge together to form a shared passage.

In the present embodiment, the second solenoid proportional valve 62 is a direct proportional valve outputting a secondary pressure that indicates a positive correlation with a command current. The pilot port of the switching valve 52 is connected to the secondary pressure line 63 by a pilot line 64.

Operation devices 44 to move the control valves 41 are disposed in the aforementioned cabin 16. Each operation device 44 includes an operating unit (an operating lever or a foot pedal) that receives an operation for moving a corresponding one of the hydraulic actuators 20, and outputs an electrical signal corresponding to an operating amount of the operating unit (e.g., an inclination angle of the operating lever).

For example, the operation devices 44 include a boom operation device, an arm operation device, and a bucket operation device, each of which includes an operating lever. The operating lever of the boom operation device receives a boom raising operation and a boom lowering operation. The operating lever of the arm operation device receives an arm crowding operation and an arm pushing operation. The operating lever of the bucket operation device receives a bucket excavating operation and a bucket dumping operation. For example, when the operating lever of the boom operation device is inclined in a boom raising direction, the boom operation device outputs a boom raising electrical signal whose magnitude corresponds to the inclination angle of the operating lever.

The electrical signal outputted from each operation device 44 is inputted to a controller 7. For example, the controller 7 is a computer including memories such as a ROM and RAM, a storage such as a HDD, and a CPU. The CPU executes a program stored in the ROM or HDD.

The controller 7 controls the first solenoid proportional valves 43 based on the electrical signals outputted from the operation devices 44. FIG. 1 shows only part of signal lines for simplifying the drawing. For example, when a boom raising electrical signal is outputted from the boom operation device, the controller 7 feeds a command current to the first solenoid proportional valve 43 connected to a boom raising pilot port of the boom control valve, and increases the command current in accordance with increase in the boom raising electrical signal.

Figure 3:
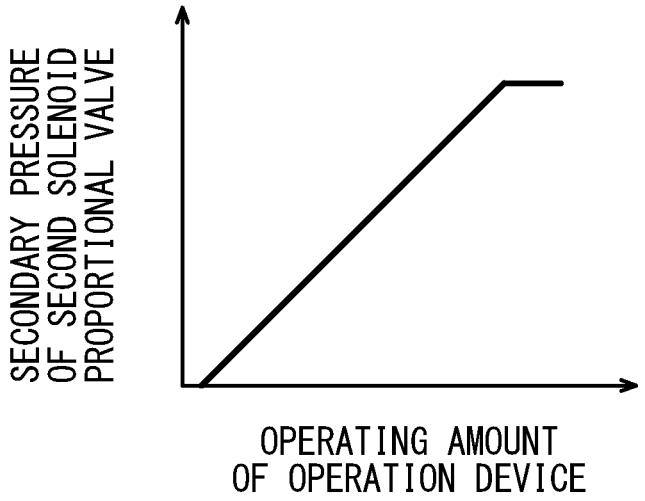
FIG. 3 is a graph showing a relationship between an operating amount of an operation device and a secondary pressure of a second solenoid proportional valve in Embodiment 1.

As shown in FIG. 3, the controller 7 controls the second solenoid proportional valve 62, such that the secondary pressure of the second solenoid proportional valve 62 increases in accordance with increase in the operating amount of each operation device 44. Accordingly, the opening area of the unloading valve 9 decreases in accordance with increase in the operating amount of each operation device 44. The operating amount of each operation device 44 and the secondary pressure of the second solenoid proportional valve 62 need not be proportional to each other. A relationship line indicating the relationship between the operating amount of each operation device 44 and the secondary pressure of the second solenoid proportional valve 62 may be a convex upward curve or a convex downward curve.

A selector 8 is disposed in the cabin 16. With the selector 8, an operator selects whether to invalidate or validate operations performed on all the operation devices 44. The selector 8 receives a selection of operation lock, which is a selection to invalidate operations performed on the operation devices 44, or receives a selection of operation lock release, which is a selection to validate operations performed on the operation devices 44.

For example, the selector 8 may be a micro switch or limit switch including a safety lever, and by shifting or swinging the safety lever, the selection of operation lock or the selection of operation lock release can be made. Alternatively, the selector 8 may be a push button switch including a button, and by pushing or not pushing the button, the selection of operation lock or the selection of operation lock release can be made.

The controller 7 controls the second solenoid proportional valve 62 in accordance with a selection status of the selector 8 in the following manner.

While the selector 8 is receiving the selection of operation lock, the controller 7 controls the second solenoid proportional valve 62, such that the secondary pressure of the second solenoid proportional valve 62 is lower than the setting value $\alpha$ of the switching valve 52 as shown in FIG. 4. As a result, the opening area of the unloading valve 9 is kept at the maximum, and also, the switching valve 52 is kept in the closed position. At the time, the controller 7 may feed no command current to the second solenoid proportional valve 62, or may feed a command current lower than the electric current value corresponding to the setting value $\alpha$ to the second solenoid proportional valve 62.

While the selector 8 is receiving the selection of operation lock release, the controller 7 controls the second solenoid proportional valve 62, such that the secondary pressure of the second solenoid proportional valve 62 is higher than the setting value $\alpha$ of the switching valve 52. As a result, the switching valve 52 is switched to the open position.

As described above, the secondary pressure of the second solenoid proportional valve 62 increases in accordance with increase in the operating amount of each operation device 44. Specifically, during the selector 8 receiving the selection of operation lock release, when none of the operation devices 44 are operated, the controller 7 feeds a standby current to the second solenoid proportional valve 62 as a command current to keep the secondary pressure of the second solenoid proportional valve 62 to a predetermined value $\gamma$, which is higher than the setting value $\alpha$ of the switching valve 52. The predetermined value $\gamma$ is a value that is equal to or close to the setting value $\beta$ of the unloading valve 9. Accordingly, the opening area of the unloading valve 9 is kept at, or kept close to, the maximum.

Then, when any one of the operation devices 44 is operated, the secondary pressure of the second solenoid proportional valve 62 is adjusted to be higher than the predetermined value $\gamma$. Thus, while the selector 8 is receiving the selection of operation lock release, the secondary pressure of the second solenoid proportional valve 62 changes between the predetermined value $\gamma$ and the maximum value in accordance with the operating amount of the operation device 44.

As described above, in the hydraulic system 1A of the present embodiment, whether to switch the switching valve 52, which is interposed between the auxiliary pump 23 and the first solenoid proportional valves 43, to the closed position or to the open position, i.e., whether to invalidate or validate operations performed on the operation devices 44, can be switched based on the secondary pressure of the second solenoid proportional valve 62. Also, the opening area of the unloading valve 9 can be changed based on the secondary pressure of the second solenoid proportional valve 62. This allows the second solenoid proportional valve 62, which is a single valve, to have two functions. Therefore, a solenoid valve dedicated for invalidating operations performed on the operation devices 44 is unnecessary.

Since the present embodiment includes the selector 8, when the operator makes the selection of operation lock with the selector 8, operations performed on the operation devices 44 are invalidated, whereas when the operator makes the selection of operation lock release with the selector 8, operations performed on the operation devices 44 are validated.

<Variation>

Figure 5:
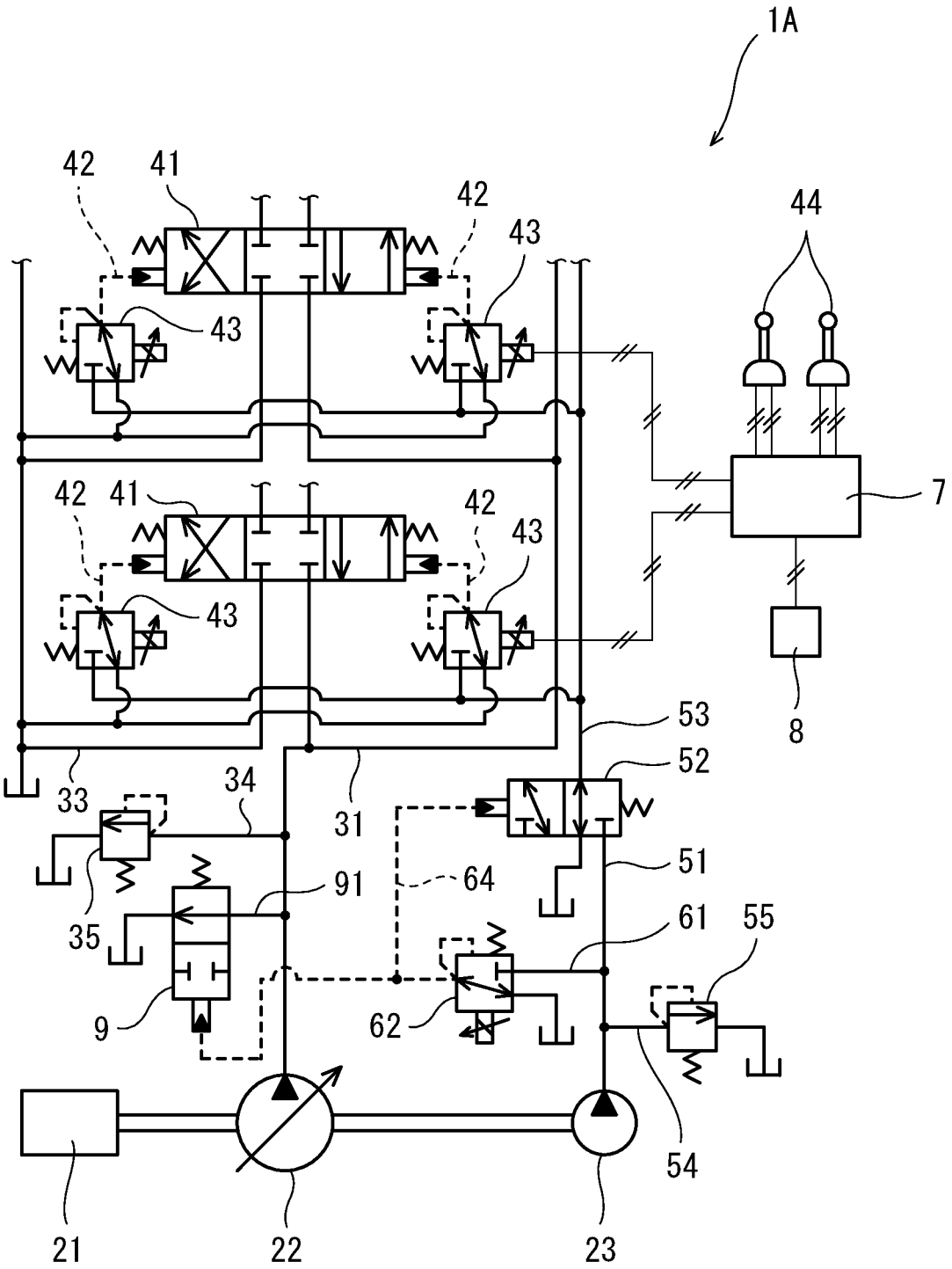
FIG. 5 shows a schematic configuration of a hydraulic system according to a variation of Embodiment 1.

As shown in FIG. 5, the center bypass line 32 may be eliminated, and instead, an unloading line 91, which is branched off from the main passage of the supply line 31 and which extends to the tank without passing through the control valves 41, may be adopted, and the unloading line 91 may be provided with the unloading valve 9. This variation is applicable to Embodiment 2 described below.

Embodiment 2

Figure 6:
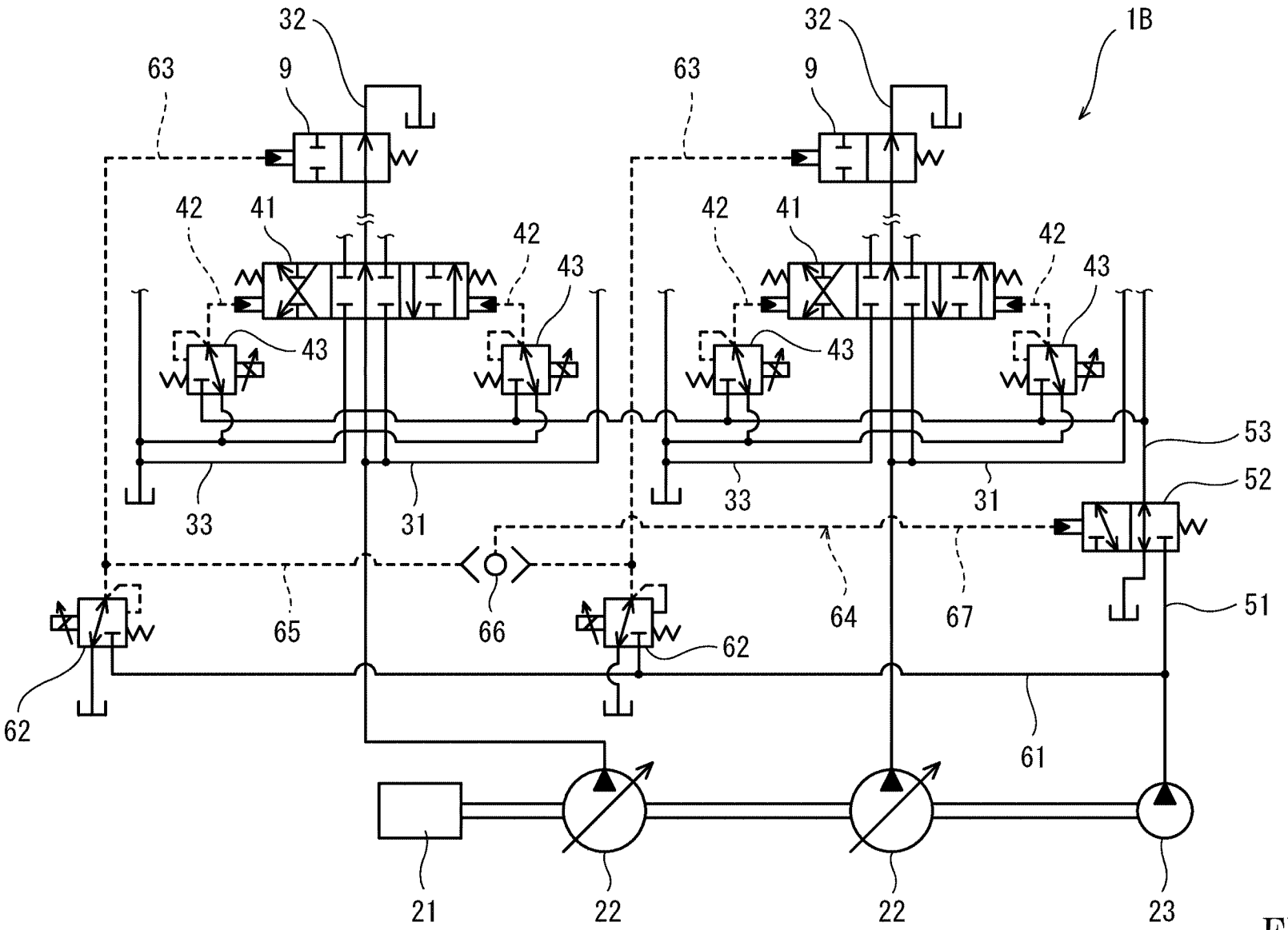
FIG. 6 shows a schematic configuration of a hydraulic system of a construction machine according to Embodiment 2 of the present invention.

FIG. 6 shows a hydraulic system 1B according to Embodiment 2 of the present invention. In the present embodiment, the same components as those described in Embodiment 1 are denoted by the same reference signs as those used in Embodiment 1, and repeating the same descriptions is avoided.

In the present embodiment, the number of main pumps 22 is two. Alternatively, the number of main pumps 22 may be three. The control valves 41 are also separated into two groups, and the control valves 41 of each group are connected to a corresponding one of the main pumps 22 by a corresponding one of supply lines 31.

Similar to Embodiment 1, the center bypass line 32 is branched off from the main passage of each supply line 31, and extends to the tank. These center bypass lines 32 are provided with respective unloading valves 9. Each unloading valve 9 includes a pilot port that is connected to a corresponding one of second solenoid proportional valves 62 by a corresponding one of secondary pressure lines 63. Both the second solenoid proportional valves 62 are connected to the auxiliary pump 23 by the primary pressure line 61.

In the present embodiment, the pilot port of the switching valve 52 is connected to both the secondary pressure lines 63 by the pilot line 64. The pilot line 64 includes: a bridging line 65, which connects the secondary pressure lines 63 to each other; a high pressure selective valve 66 provided on the bridging line 65; and an output line 67, which connects between an output port of the high pressure selective valve 66 and the pilot port of the switching valve 52. The high pressure selective valve 66 selects a higher one of the secondary pressures of the two second solenoid proportional valves 62, and outputs the selected secondary pressure from the output port.

According to the above configuration, even if one of the second solenoid proportional valves 62 stops working due to a failure or the like (e.g., an energization failure caused by, for example, snapping of a cable), the switching valve 52 can still be switched between the closed position and the open position. Consequently, the occurrence of a situation where the construction machine 10 stops working due to a failure is reduced, and the reliability of the construction machine 10 is improved.

Other Embodiments

The present invention is not limited to the above-described embodiments. Various modifications can be made without departing from the scope of the present invention.

For example, the unloading valve 9 may be a normally closed valve. In this case, the switching valve 52 switches from the open position to the closed position when the pilot pressure becomes higher than or equal to a relatively high setting value. In the case where the unloading valve 9 is a normally closed valve, the second solenoid proportional valve 62 may be either a direct proportional valve or an inverse proportional valve.

The invention claimed is:

1. A hydraulic system of a construction machine, comprising:

control valves interposed between a main pump and hydraulic actuators, each control valve including pilot ports;

first solenoid proportional valves connected to the pilot ports of the control valves;

operation devices to move the control valves, each operation device outputting an electrical signal corresponding to an operating amount of the operation device;

a controller that controls the first solenoid proportional valves based on the electrical signals outputted from the operation devices;

an unloading valve provided on a line extending to a tank, the line being branched off from a supply line that connects between the main pump and the control valves, the unloading valve including a pilot port and being a valve whose opening area is at a maximum when none of the operation devices are operated;

a second solenoid proportional valve connected to the pilot port of the unloading valve by a secondary pressure line and connected to an auxiliary pump by a primary pressure line; and a switching valve interposed between the auxiliary pump and the first solenoid proportional valves, the switching valve including a pilot port connected to the secondary pressure line by a pilot line, the switching valve switching between a closed position and an open position in accordance with a pilot pressure led to the pilot port.

2. The hydraulic system of a construction machine according to claim 1, wherein the opening area of the unloading valve decreases in accordance with increase in a pilot pressure led to the pilot port of the unloading valve, and the switching valve switches from the closed position to the open position when the pilot pressure led to the pilot port of the switching valve becomes higher than or equal to a setting value.

3. The hydraulic system of a construction machine according to claim 2, further comprising:

a selector that receives a selection of operation lock, which is a selection to invalidate operations performed on the operation devices, or receives a selection of operation lock release, which is a selection to validate operations performed on the operation devices, wherein while the selector is receiving the selection of operation lock, the controller controls the second solenoid proportional valve, such that a secondary pressure of the second solenoid proportional valve is lower than the setting value, and while the selector is receiving the selection of operation lock release, the controller controls the second solenoid proportional valve, such that the secondary pressure of the second solenoid proportional valve is higher than the setting value.

4. The hydraulic system of a construction machine according to claim 3, wherein the setting value is a first setting value, the opening area of the unloading valve is kept at the maximum until the pilot pressure led to the pilot port of the unloading valve becomes a second setting value, and the first setting value is lower than or equal to the second setting value.

5. The hydraulic system of a construction machine according to claim 4, wherein the main pump includes a plurality of main pumps, the unloading valve includes a plurality of unloading valves corresponding to the respective main pumps, the second solenoid proportional valve includes a plurality of second solenoid proportional valves corresponding to the respective unloading valves, and the pilot line includes:

a bridging line that connects secondary pressure lines to each other, the secondary pressure lines extending from the respective second solenoid proportional valves;

a high pressure selective valve provided on the bridging line; and an output line that connects between an output port of the high pressure selective valve and the pilot port of the switching valve.

6. The hydraulic system of a construction machine according to claim 3, wherein the main pump includes a plurality of main pumps, the unloading valve includes a plurality of unloading valves corresponding to the respective main pumps, the second solenoid proportional valve includes a plurality of second solenoid proportional valves corresponding to the respective unloading valves, and the pilot line includes:

a bridging line that connects secondary pressure lines to each other, the secondary pressure lines extending from the respective second solenoid proportional valves;

a high pressure selective valve provided on the bridging line; and an output line that connects between an output port of the high pressure selective valve and the pilot port of the switching valve.

7. The hydraulic system of a construction machine according to claim 2, wherein the setting value is a first setting value, the opening area of the unloading valve is kept at the maximum until the pilot pressure led to the pilot port of the unloading valve becomes a second setting value, and the first setting value is lower than or equal to the second setting value.

8. The hydraulic system of a construction machine according to claim 7, wherein the main pump includes a plurality of main pumps, the unloading valve includes a plurality of unloading valves corresponding to the respective main pumps, the second solenoid proportional valve includes a plurality of second solenoid proportional valves corresponding to the respective unloading valves, and the pilot line includes:

a bridging line that connects secondary pressure lines to each other, the secondary pressure lines extending from the respective second solenoid proportional valves;

a high pressure selective valve provided on the bridging line; and an output line that connects between an output port of the high pressure selective valve and the pilot port of the switching valve.

9. The hydraulic system of a construction machine according to claim 2, wherein the main pump includes a plurality of main pumps, the unloading valve includes a plurality of unloading valves corresponding to the respective main pumps, the second solenoid proportional valve includes a plurality of second solenoid proportional valves corresponding to the respective unloading valves, and the pilot line includes:

a bridging line that connects secondary pressure lines to each other, the secondary pressure lines extending from the respective second solenoid proportional valves;

a high pressure selective valve provided on the bridging line; and an output line that connects between an output port of the high pressure selective valve and the pilot port of the switching valve.

10. The hydraulic system of a construction machine according to claim 1, wherein the main pump includes a plurality of main pumps, the unloading valve includes a plurality of unloading valves corresponding to the respective main pumps, the second solenoid proportional valve includes a plurality of second solenoid proportional valves corresponding to the respective unloading valves, and the pilot line includes:

a bridging line that connects secondary pressure lines to each other, the secondary pressure lines extending from the respective second solenoid proportional valves;

a high pressure selective valve provided on the bridging line; and an output line that connects between an output port of the high pressure selective valve and the pilot port of the switching valve.

* * * * *